United States Patent [19]

Bradford, Sr.

[11] 4,238,906

[45] Dec. 16, 1980

[54] FLYING TOY

[76] Inventor: Joseph Bradford, Sr., 11145 Cypress Glenn, Baton Rouge, La. 70807

[21] Appl. No.: 923,041

[22] Filed: Sep. 25, 1978

[51] Int. Cl.[3] ..... A63H 27/00; A63B 65/08

[52] U.S. Cl. ..... 46/74 D; 273/426

[58] Field of Search ..... 273/106 D, 106 E, 106 F; 46/74 R

[56] References Cited

U.S. PATENT DOCUMENTS

| | | | |
|---|---|---|---|
| 213,804 | 4/1869 | Hunnicutt | 273/106 D |
| 3,353,295 | 11/1967 | Downey | 46/74 R |
| 3,403,910 | 10/1968 | Claycomb | 273/106 D |
| 3,881,729 | 5/1975 | Block et al. | 273/106 D |
| 3,955,017 | 5/1976 | Davis | 273/106 D |

FOREIGN PATENT DOCUMENTS

| | | | |
|---|---|---|---|
| 411972 | 6/1910 | France | 273/106 D |

OTHER PUBLICATIONS

"Cloud Chamber," *Playthings* Magazine, Apr. 1959, p. 115.

*Primary Examiner*—Louis G. Mancene
*Assistant Examiner*—Michael J. Foycik
*Attorney, Agent, or Firm*—Edwin E. Greigg; Felix J. D'Ambrosio; Thomas E. McDonald

[57] ABSTRACT

A flying toy of the boomerang type having two airfoil arms extending horizontally from a center portion. Each arm carries at its outer end a horizontally disposed, annular-shaped stabilizer having a horizontally disposed outer periphery whose diameter is approximately twice the horizontal width of the arm at the juncture of the arm and the stabilizer, and having an inner periphery which is disposed in the same horizontal plane as the outer periphery, and which defines a center opening through the stabilizer. The stabilizer has a convex top annular surface and a concave bottom annular surface extending between the inner and outer peripheries. During flight, the stabilizers serve simultaneously as airfoils, airfoil arm stabilizers, and a gyroscope for the flying toy.

5 Claims, 4 Drawing Figures

FIG. 1.
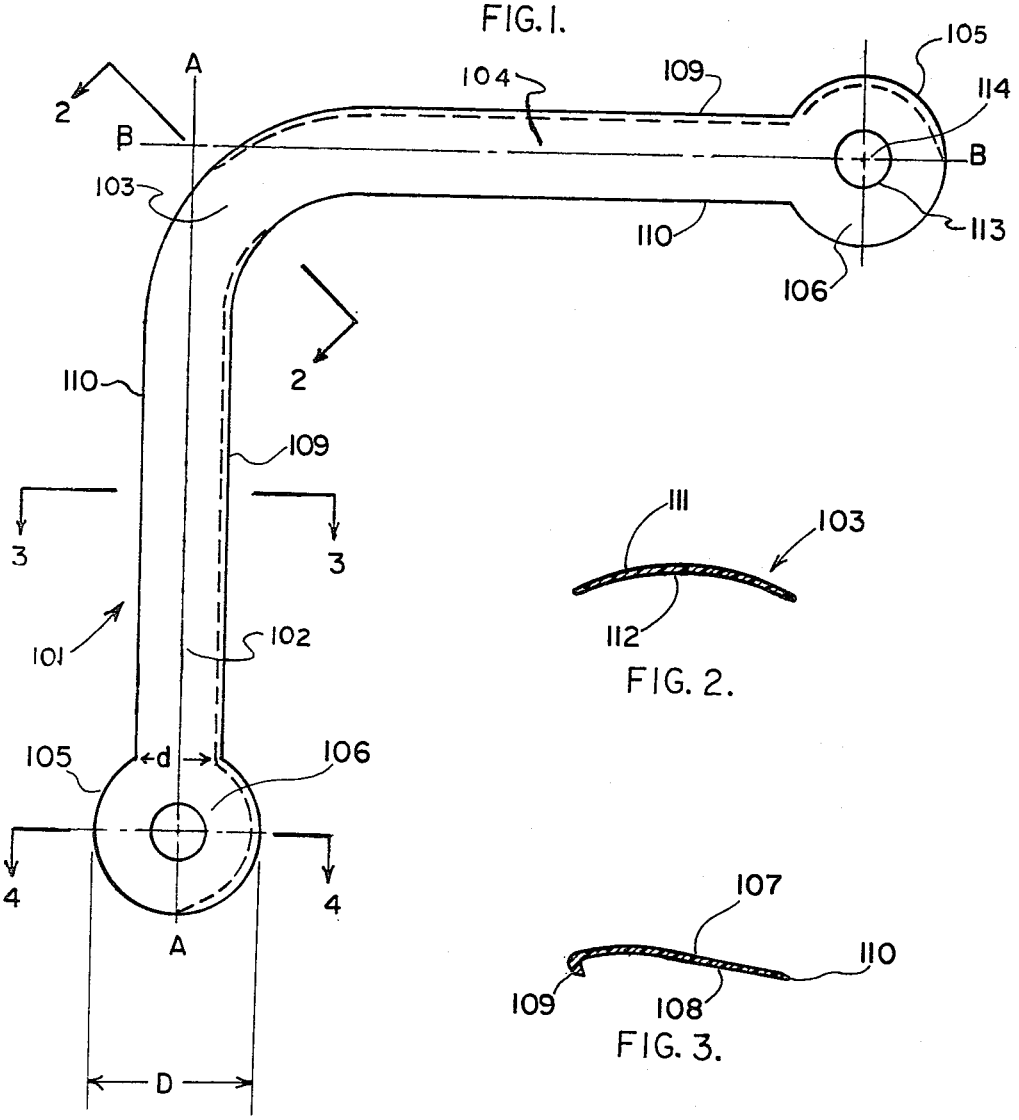
FIG. 2.
FIG. 3.
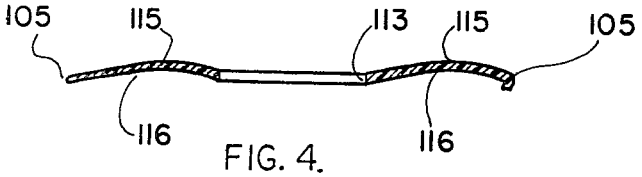
FIG. 4.

FLYING TOY

BACKGROUND OF THE INVENTION

1. Field of the Invention

The invention relates generally to flying toys, and in particular, to flying toys of the boomerang type having two airfoil portions or arms extending from a central portion and disposed substantially in a common plane.

2. Prior Art

U.S. Pat. No. 3,955,817, issued May 11, 1976 to James E. Davis, describes a boomerang constructed of three or more airfoils, equiangularly disposed about a common axis, and extending radially outward to a circular rim member which provides increased angular momentum and enhances the gyroscopic stability of the boomerang once it is launched. The boomerang also includes an axially extending stabilizer rod.

U.S. Pat. No. 3,881,729, issued May 6, 1975 to Block et al, discloses a flying toy of the boomerang type having either three or four equiangularly spaced arms extending radially from a common junction. The arms have alternate or consecutive tips turned upward and downward, and the central junction is provided with an air permeable aerodynamic resistance element in the form of a cylindrical tube to provide a smooth non-fluttering flight, and to sharply decrease the linear speed of the flying toy towards the end of its flight.

OBJECTS AND SUMMARY OF THE INVENTION

It is an object of the invention to provide a flying toy having individual stabilizer elements for each airfoil arm, which also serve as airfoil elements to provide additional lift to the device.

It is a further object of the invention that the stabilizer elements enhance the gyroscopic stability of the flying toy.

The flying toy described herein is a boomerang type device having a center portion carrying two airfoils, or arms, which extend angularly outward from the center portion in a common plane, the angle between the two arms being at least 90° . The outer end of each arm carries an annular-shaped stabilizer, which is disposed in the common plane of the two arms. The stabilizer has concentric inner and outer peripheries, the inner periphery defining a center opening of the stabilizer and the outer periphery having a diameter approximately twice the width of the arm carrying the stabilizer. The top annular surface between the inner and outer peripheries of the stabilizer is convex, and the bottom annular surface between the inner and outer peripheries of the stabilizer is concave, so that the stabilizer also acts as an airfoil element. However, because of the center opening in the stabilizer, air will flow upward through the center opening during flight of the device to reduce the lift at this point and thus stabilize the arm. Also, during flight, the two stabilizers provide additional angular momentum and enhance the gyroscopic stability of the device.

Other objects and advantages will become apparent from a study of the following description together with the accompanying drawing wherein:

BRIEF DESCRIPTION OF THE DRAWINGS

FIG. 1 is a top view of the one embodiment of the invention;

FIG. 2 is a cross-sectional view of a central portion of the embodiment of FIG. 1, as viewed along the lines 2—2 of FIG. 1;

FIG. 3 is a cross-sectional view of one of the arms of the embodiment of FIG. 1, taken along the lines 3—3 of FIG. 1; and FIG. 4 is a cross-sectional view of one of the stabilizers of the embodiment shown in FIG. 1, taken along lines 4—4 of FIG. 1.

DESCRIPTION OF THE PREFERRED EMBODIMENT

Referring now to FIGS. 1–4, the flying toy 101 includes two airfoil arms 102, 104, which have inner ends joined by a curved center portion 103, and outer ends joined respectively to the outer peripheries 105 of two annular-shaped stabilizers 106, with all portions 102–106 of the device 101 being disposed in essentially the same horizontal plane. The arms 102, 104 extend outward from the center portion 103 along respective horizontal axes A—A, B—B which intersect at an angle of at least 90°.

As best seen in FIG. 3, each arm 102 or 104 has a generally convex upper surface 107 and a generally concave lower surface 108, extending between a leading edge 109 and a trailing edge 110, to cause the air flowing across the convex upper surface 107 to have a longer path than the air flowing across the concave lower surface 108 to thus produce a differential pressure in an upward direction on each arm 102 or 104. The center portion 103 also has a convex upper surface 111 extending between the convex upper surfaces 107 of the arms 102, 104 and a concave lower surface 112 extending between the concave lower surfaces 108 of the arms 102, 104, as shown in FIG. 2.

Each stabilizer 106 has a circular, horizontally disposed, inner periphery 113 which defines a center opening 114 disposed symetrically along the horizontal axis A—A or B—B of the adjoining arm 102 or 104, and concentrically within the circular outer periphery 105 of the stabilizer 106. The outer periphery 105 of each stabilizer 106 is disposed in the same horizontal plane as the inner periphery 113, and extends from the adjoining arm 102 or 104 approximately 300° about the center opening 114. Thus, the outer diameter D of each stabilizer 106 is approximately twice the width d of the adjoining arm 102 or 104 between its leading and trailing edges 109, 110 at the juncture of the stabilizer 106 and the arm 102 or 104, to provide additional angular momentum and enhance the gyroscopic stability of the device 101 during flight.

The top annular surface 115 between the inner and outer peripheries 113, 105 of each stabilizer 106 is a convex surface, and the bottom annular surface 116 between the inner and outer peripheries 113, 105 of each stabilizer 106 is a concave surface. Thus, each stabilizer 106 acts as an airfoil during flight of the device 101, since the path of the air flowing across the convex top annular surface 115 of each stabilizer 106 will be longer than the path of the air flowing across its concave bottom annular surface 116. However, the difference in pressure between the air flowing across the top and bottom surfaces 115, 116 of the stabilizers 106 will cause air to be drawn upward through the opening 114, which reduces the lifting forces at these points and acts to stabilize the arms 102, 104 during flight.

It is not essential to the invention that the bottom annular surface 116 of the stabilizer 106 be a concave surface, but only that the convex top annular surface 115 is relatively more convex than the bottom annular surface 116 so that the path of air flowing across the convex top annular surface 115 will be longer than the path of air flowing across the bottom annular surface 116 during a flight of the device 101. Thus, the bottom annular surface 112 could be a flat surface or even a slightly convex surface.

Similarly, it is not essential to the invention that the lower surfaces 108 of the arms 102 and 104 be concave surfaces, but only that the convex upper surface 107 of each arm 102, 104 is relatively more convex relative to the corresponding lower surface 108 of the arm, so that the path of air flowing across the convex upper surface 107 will be longer than the path of air flowing across the lower surface 108 during flight, and the difference in the rate of flow of air across the upper and lower surfaces 107, 108 will produce a differential pressure which acts in an upward direction on the arm 102 or 104. Thus, the lower surfaces 108 could be flat or even slightly convex.

Since these and other changes or modifications can be made to the single illustrated embodiment of the invention described herein, it is intended that the scope of this invention be limited only by the appended claims.

I claim:

1. In a flying device of the boomerang type having two airfoil arms disposed in a horizontal plane and extending from a center portion along respective horizontal axes which intersect at an angle of at least ninety degrees, the improvement wherein each arm carries at its outer end an annular-shaped stabilizer having:

concentric inner and outer peripheries which are disposed essentially in the same horizontal plane, the inner periphery defining a center opening through the stabilizer;

an annular bottom surface extending between the inner and outer peripheries of the stabilizer; and a convex annular top surface extending between the inner and outer peripheries of the stabilizer, wherein the convex annular top surface is relatively more convex in shape than the annular bottom surface.

2. A device, as described in claim 1, wherein the annular bottom surface of the stabilizer is a concave surface.

3. A device, as described in claim 1, wherein the outer diameter of the stabilizer is greater than the horizontal width of the adjoining arm at the juncture of the arm and the stabilizer.

4. A device, as described in claim 3, wherein the outer diameter of the stabilizer is approximately twice the horizontal width of the adjoining arm at the juncture of the arm and the stabilizer.

5. A device, as described in claim 1, wherein each airfoil arm includes:

horizontally disposed leading and trailing edges;

a convex upper surface extending between the leading and trailing edges; and a concave lower surface, extending between the leading and trailing edges.

* * * * *